US005396741A

United States Patent [19]

Adlam

[11] Patent Number: 5,396,741

[45] Date of Patent: Mar. 14, 1995

[54] VISUAL CONTROL TOWERS

[75] Inventor: Francis C. Adlam, Bury, United Kingdom

[73] Assignee: Alifabs Limited, Surrey, England

[21] Appl. No.: 78,869

[22] Filed: Jun. 21, 1993

[30] Foreign Application Priority Data

Jul. 13, 1992 [GB] United Kingdom ..... 9214859

[51] Int. Cl.[6] ..... E04H 12/00

[52] U.S. Cl. ..... 52/40; 52/73

[58] Field of Search ..... 52/40, 73, 236.2, 274, 52/263, 236.1, 73; 249/48

[56] References Cited

U.S. PATENT DOCUMENTS

| | | | |
|---|---|---|---|
| 2,403,369 | 7/1946 | Huber | 52/274 |
| 3,125,189 | 3/1964 | Graham | 52/73 |
| 3,246,431 | 4/1966 | Faerber | 52/73 |
| 3,255,990 | 6/1966 | Williams | 249/48 |
| 3,584,911 | 6/1972 | Coletto | 296/1 |
| 5,200,759 | 4/1993 | McGinnis | 52/111 |

FOREIGN PATENT DOCUMENTS

| | | |
|---|---|---|
| 0068735 | 1/1983 | European Pat. Off. . |
| 445426 | 4/1936 | United Kingdom . |
| 2228956 | 1/1990 | United Kingdom . |

OTHER PUBLICATIONS

Washington Post Publication, Mar. 30, 1992, p. D#.
Popular Mechanics, Dec. 1959, p. 113.

*Primary Examiner*—James L. Ridgill, Jr.
*Attorney, Agent, or Firm*—Wenderoth, Lind & Ponack

[57] ABSTRACT

The control room of an airport control tower is octagonal and has windows at at least two ends of the room, and work stations for controllers adjacent these windows. Each of the two windows extends along three adjoining sides of the room, and the work station is disposed behind the window at the middle of the three sides. The controller at each work station has a lateral field of view of at least 180° unobstructed by mullions or other structural supporting elements. The windows are composed of planar transparent panels, and sealing elements which pose no significant obstruction to vision are provided at the joints between the panels.

9 Claims, 4 Drawing Sheets

VISUAL CONTROL TOWERS

BACKGROUND OF THE INVENTION

This invention relates to control towers, and primarily to visual control towers for airports where a wide field of view from the control room is essential.

SUMMARY OF THE INVENTION

According to this invention a visual control tower comprises a support structure and a polygonal control room carried by the support structure, the control room having, at each of at least two sides thereof, a work station for a controller and a window composed of a plurality of planar transparent panels each of which is disposed outwardly of the area enclosed by the support structure and is inclined so as to face outward and downward. Each of the windows is arranged to provide a controller at the work station at the window with a lateral field of view of 180° or more through the window, which field is uninterrupted by mullions or other structural supporting elements.

The work stations and said windows are preferably disposed at opposite ends of the control room.

In preferred forms of the control tower according to the invention, the control room has a third and a fourth window disposed at opposite sides of the control room and each of the third and fourth window is inclined so as to face outward and downward and extends between the two windows which are disposed at opposite ends of the control room. Each of the third and fourth windows is composed of a plurality of planar transparent panels. In one such construction the third and fourth windows are disposed outwardly of the area enclosed by the support structure, and a further work station for a controller is disposed substantially centrally of the length of at least one of the third and fourth windows, the arrangement being such that for a controller at the further work station there is provided a lateral field of view of 180° or more through the window, which field is uninterrupted by mullions or other structural supporting elements.

BRIEF DESCRIPTION OF THE DRAWING

The invention will now be described in more detail with reference by way of example to the accompanying drawings in which.

DETAILED DESCRIPTION OF THE INVENTION

Figure 1:
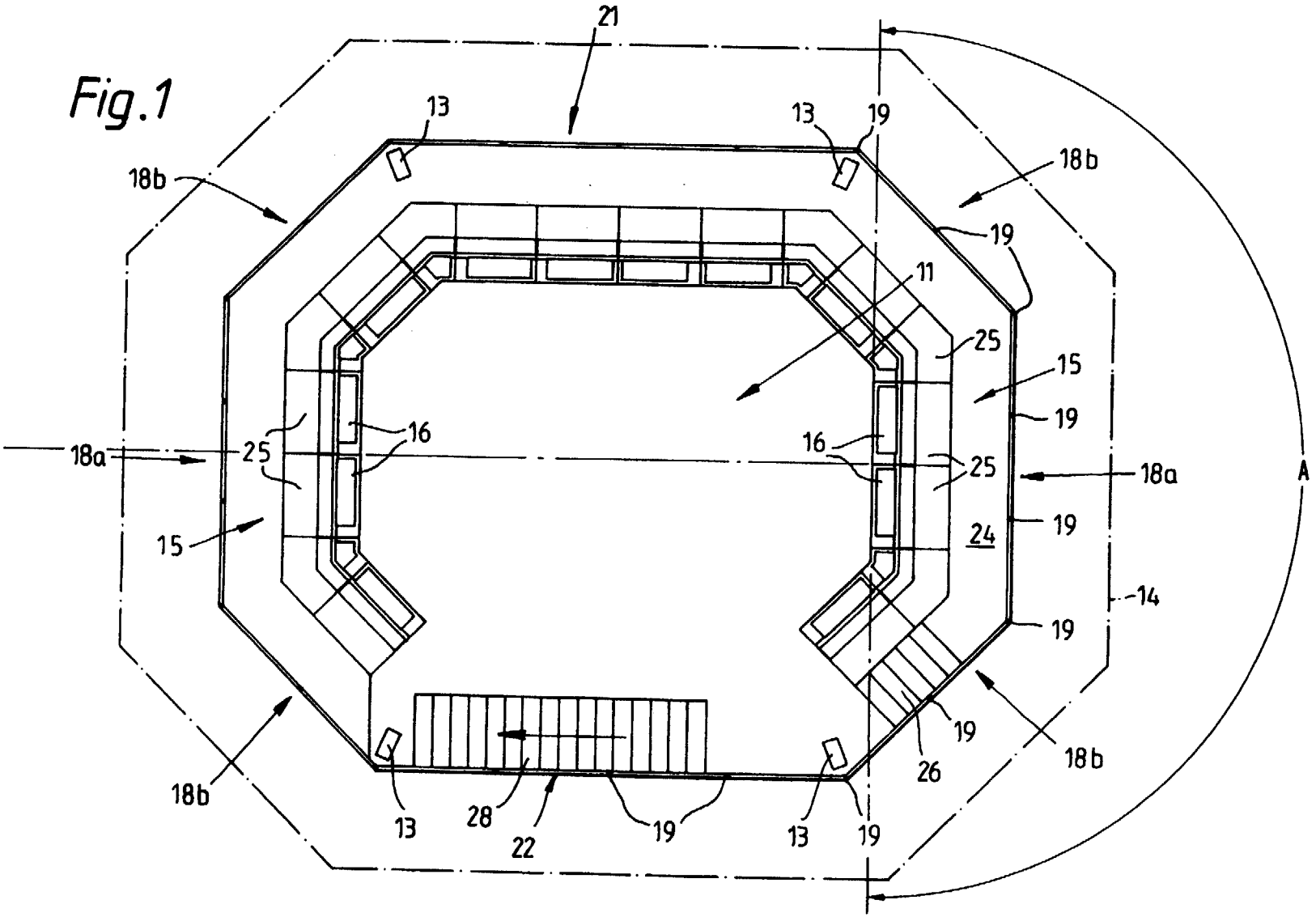
FIG. 1 is a plan view of a control room of a first control tower according to the invention.
Figure 2:
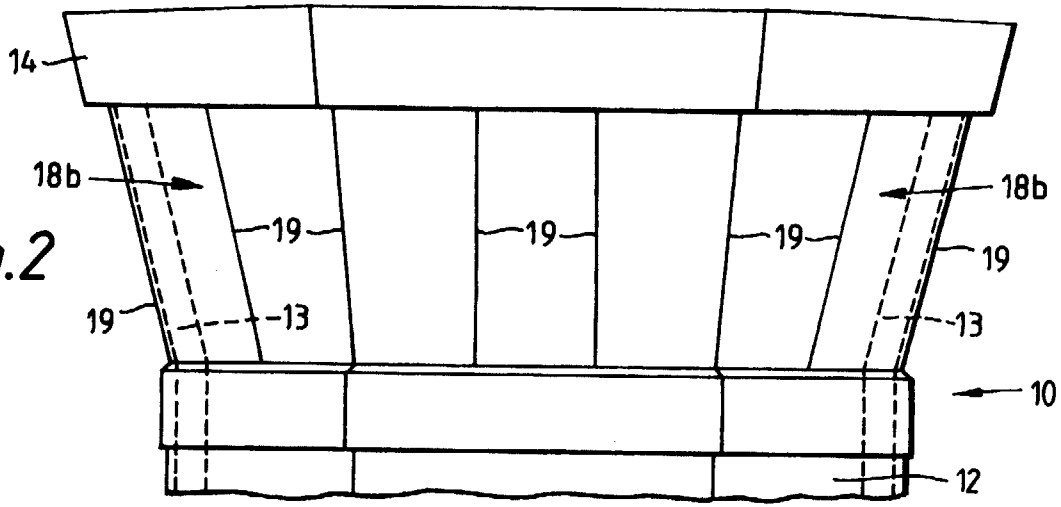
FIG. 2 is an end view of part of the control tower of FIG. 1.
Figure 3:
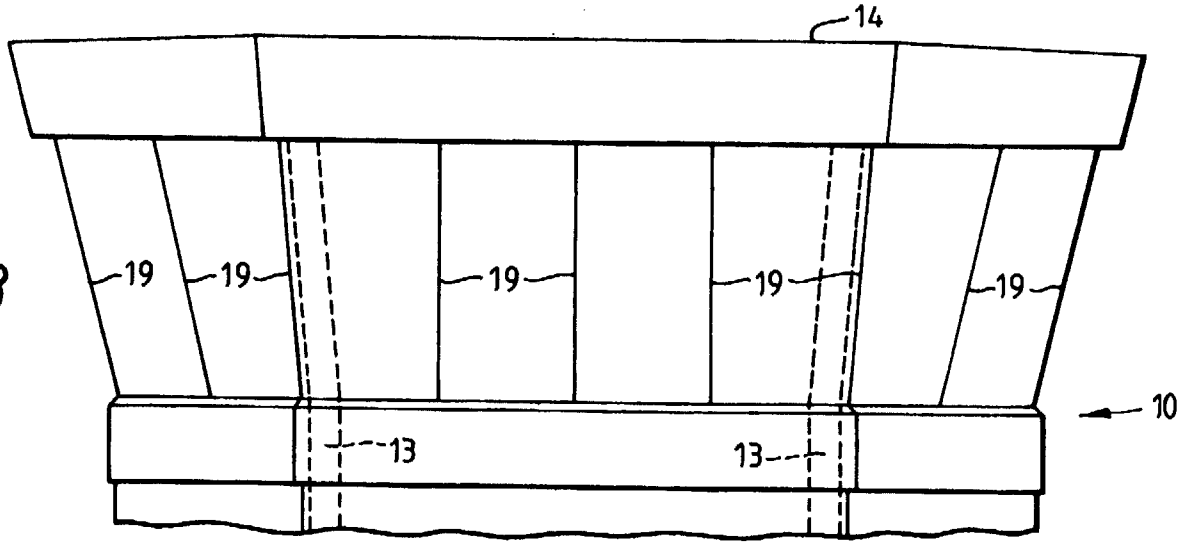
FIG. 3 is a side view of the control tower of FIG. 1.

Referring first to FIGS. 1 to 3, the control tower 10 comprises a polygonal control room 11 mounted in an elevated position on a support structure generally indicated at 12. The support structure includes four support columns 13 which support a roof structure 14 and which jointly define a rectangular area where they extend upward through the control room. As shown in the drawings the upper portions of the columns 13 are inclined and extend parallel to respective adjacent window panels of the control room. The outline of the roof structure 14 is shown in chain lines in FIG. 1. Opposite ends of the control room project outward beyond the rectangular area defined by columns 13. Outside the rectangular area, at opposite ends of the control room, are two end bays 15 in which central work stations 16 for controllers are provided. Each of the end bays 15 has a window formed in several multi-panel sections i.e. a three-panel central section **18*a*, and two two-panel end sections 18*b* which flank the section 18*a* at opposite sides, respectively, and extend at 45° to the central section, and all the panels of which are inclined so as to face outward and downward at an angle of approximately 15° to the vertical. The middle panel of the central section is rectangular and the adjacent panels and all of the panels in the two end sections are trapezoidal. The lateral field of view from the central work station or stations 16 at each window 18*a*, 18*b* is uninterrupted by mullions or other structural elements where the sections adjoin each other. The joints between panels are sealed by sealing elements 19 made for example from a silicone rubber material which forms only a thin visual line and does not impede lateral vision to a material extent. Since controllers in the two end bays are also forward of the support columns 13, which, as clear from the drawings are the only structural features capable of interrupting the lateral field of view, and are thus outside the rectangular area enclosed by the columns, a controller at either of the works stations 16 in each of the end bays 15** has an unimpeded lateral field of view over an angle A of substantially 180°. In consequence of this arrangement, the control tower can be placed so as to enable two runways to be under observation by controllers with a very wide unimpeded lateral field of view from opposite end bays respectively of the control room.

Multi-panel observation windows 21 and 22 along the third and fourth sides of the control room extend along opposite sides between the two end bays 15 and are glazed in the same manner as the bays 15 using glass panels with sealing elements 19 at the joins.

A peripheral platform 24 extends along three sides of the room between the windows and the electronic and other control equipment 25 disposed in front of the work stations. Platform 24 is at a lower level (e.g. 1.2 m lower) than the floor of the room to enable technicians to service this equipment without obstructing the field of view of the controllers. Platform 24 is reached from the floor of the room by a short downward staircase 26.

An access staircase 28 to the control room is provided adjacent the observation window 22.

Figure 4:
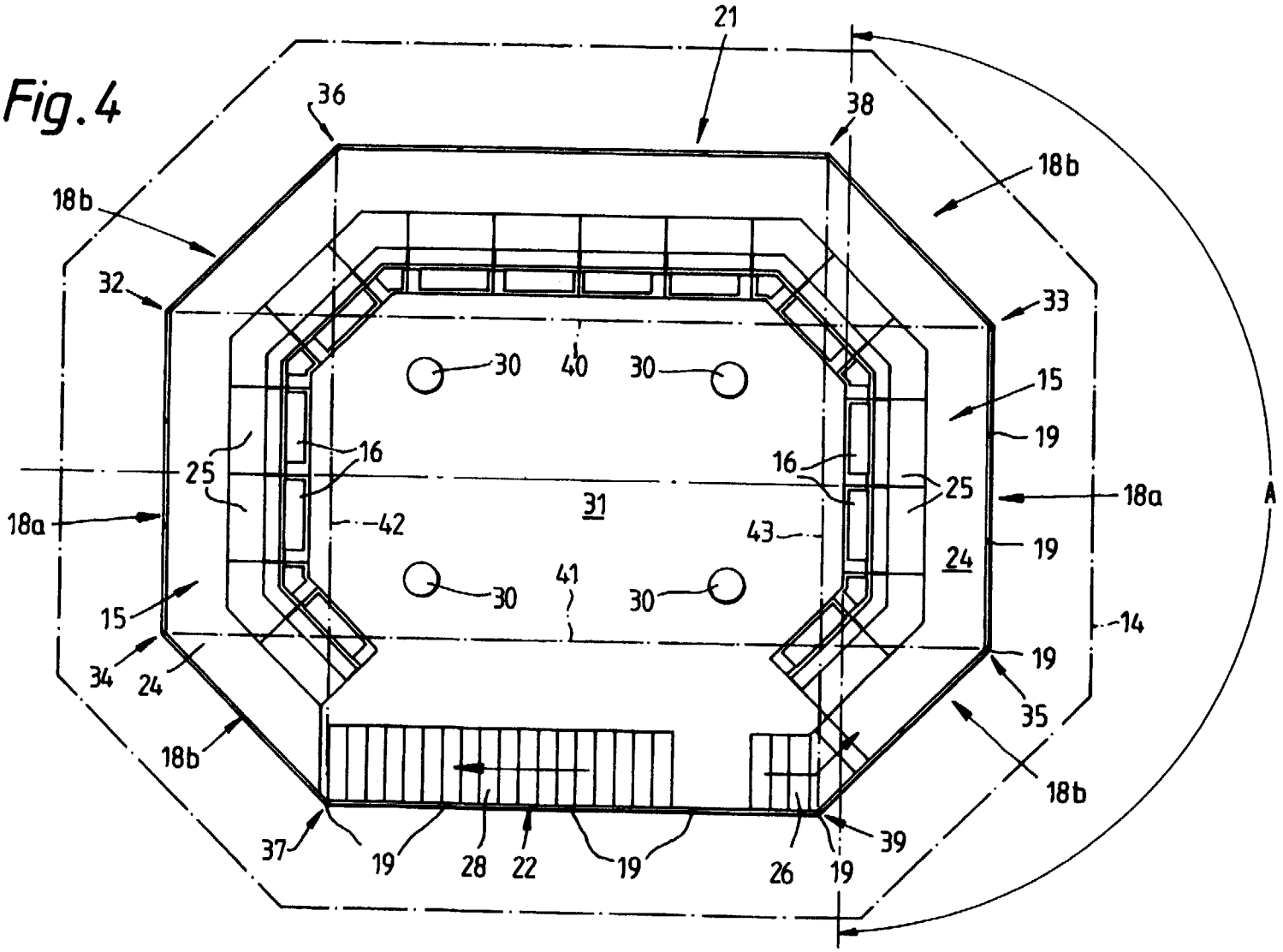
FIGS. 4 to 6 are views corresponding to FIGS. 1 to 3, respectively, but showing a second control tower according to the invention.
Figure 5:
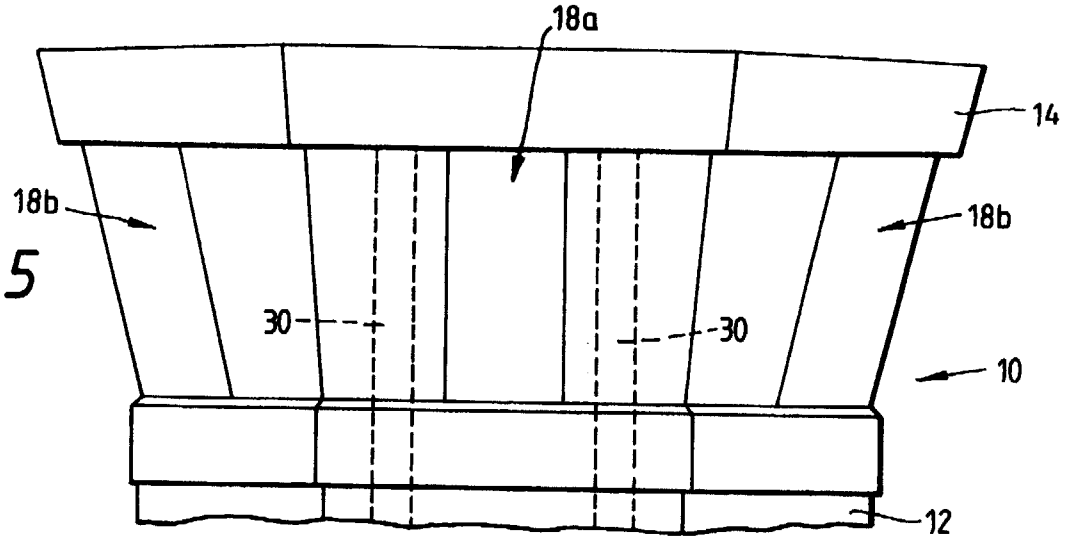
Figure 6:
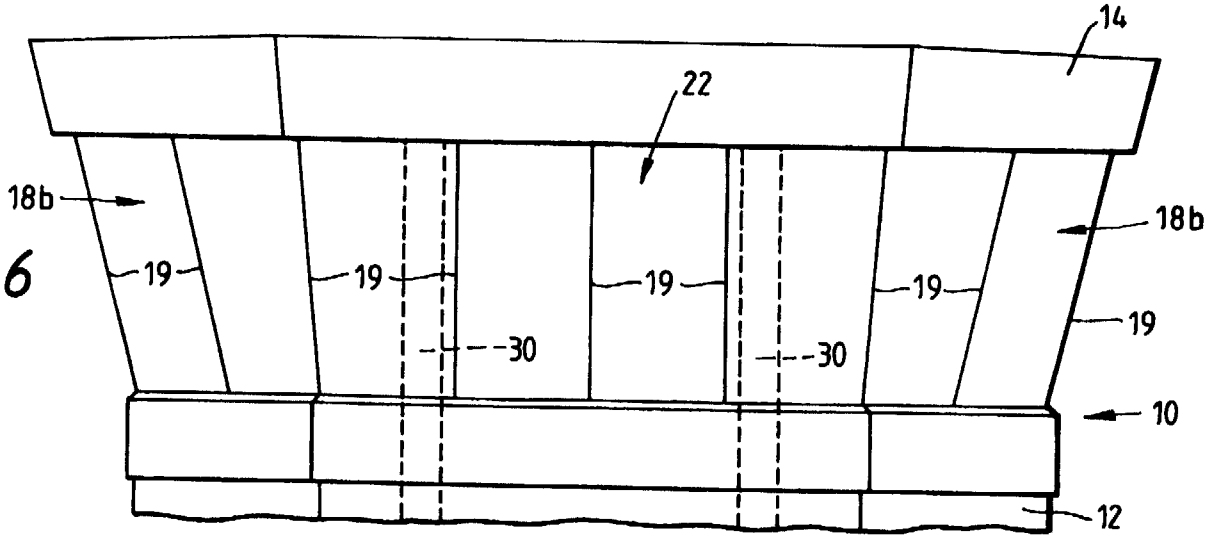

The arrangement illustrated in FIGS. 4 to 6 of the drawings is generally similar to that in FIGS. 1 to 3 and corresponding components in the two arrangement are indicated by the same reference numerals. In the construction of FIGS. 4 to 6, however, the angled roof support columns 13 of FIGS. 1 to 3 are replaced by straight support columns 30 which are spaced inward of the windows and extend upward through the central floor area 31 of the room. In consequence the rectangular area enclosed by the columns is smaller than in the arrangement of FIGS. 1 to 3. This rectangle is wholly within a second rectangular area enclosed by lines 40, 41, 42, 43 extending respectively between the corners 32 and 33, 34 and 35, 36 and 37, and 38 and 39 of the windows. That is, as shown in FIG. 4, the four structural columns lie between a first pair of parallel lines respectively extending between respective first lateral sides of the central portions of the first and second contiguous pluralities of planar transparent panels and between respective second lateral sides of the central portions of the first and second contiguous pluralities of planar transparent panels, and the four structural columns lie between a second pair of parallel lines respectively extending between respective first lateral sides of the third and fourth contiguous pluralities of planar transparent panels and between respective second lateral sides of the third and fourth contiguous pluralities of planar transparent panels. The columns 30 are therefore well behind controllers at the work stations 16 and provide the controllers with a field of view in excess of 180°. This arrangement also makes possible a third work station which can be disposed behind the window 21 extending along the third side of the control room and which provides a field of view in excess of an angle A of 180° for a controller at this work station.

As in the arrangement of FIG. 1, all the windows are formed in planar panels and are inclined outward and downward at 15° to the vertical. The windows do not have, neither at or intermediate their ends, any mullions or other supporting structural elements interrupting the field of view. The sides of the end panels of the third and fourth windows 21 and 22 are sealed with respect to the adjoining end sections **18*b* of the first and second windows by sealing elements 19 made from a silicone rubber substance which forms only a thin line and does not impede vision to a material extent. Thus there is at each of the four sides of the control room a lateral field of view in excess of 180° through the window at that side; in the case of the third and fourth windows 21, 22 the field of view is achieved by using the adjoining end sections 18*b*** of the first and second windows.

I claim:

1. A tower structure comprising:

a room having side walls and a roof mounted atop said side walls;

a plurality of supporting columns extending upwardly through said room to said roof and supporting said room by supporting said roof;

a first work station provided in said room at a first side portion of said room, outwardly of said plurality of supporting columns, and inwardly of a first contiguous plurality of said side walls, wherein each side wall of said first contiguous plurality of said side walls comprises a planar transparent panel facing outwardly and downwardly, such that said first contiguous plurality of said side walls constitutes a first contiguous plurality of planar transparent panels, and wherein said first work station is so located relative to said first contiguous plurality of planar transparent panels and said support structure that said first contiguous plurality of planar transparent panels constitutes a means for providing a controller at said first work station with a lateral field of view of at least 180 degrees through said first contiguous plurality of planar transparent panels, which field of view is uninterrupted by mullions or other structural supporting elements, and a second work station provided in said room at a second side portion of said room, outwardly of said plurality of supporting columns, and inwardly of a second contiguous plurality of said side walls, wherein each side wall of said second contiguous plurality of said side Walls comprises a planar transparent panel facing outwardly and downwardly, such that said second contiguous plurality of said side walls constitutes a second contiguous plurality of planar transparent panels, and wherein said second work station is so located relative to said second contiguous plurality of planar transparent panels and said plurality of supporting columns that said second contiguous plurality of planar transparent panels constitutes a means for providing a controller at said second work station with a lateral field of view of at least 180 degrees through said second contiguous plurality of planar transparent panels, which field of view is uninterrupted by mullions or other structural supporting elements.

2. A tower structure as recited in claim 1, wherein said room is provided with a floor;

said first and second work stations comprise control equipment for a controller;

a walkway is provided between said first work station and said first contiguous plurality of planar transparent panels and between said second work station and said second contiguous plurality of planar transparent panels, and said walkway is disposed at a lower level than said floor of said room so as to enable a maintenance worker to work on said control equipment without obstructing the controller's view through said first or second contiguous plurality of planar transparent panels.

3. A tower structure as recited in claim 1, wherein said first side portion and said second side portion are at opposite ends of said room.

4. A tower structure as recited in claim 3, wherein first and second additional ones of said side walls are provided at opposite sides of said room and between said first and second contiguous plurality of planar transparent panels;

each of said first and second additional side walls comprises a plurality of contiguous planar transparent panels such that said first and second additional side walls respectively constitute a third and a fourth plurality of contiguous transparent panels; and each of said third and fourth plurality of contiguous transparent panels faces outwardly and downwardly.

5. A tower structure as recited in claim 4, further comprising a third work station provided in said room at a third side portion of said room, at a substantially longitudinally central location of said third contiguous plurality of planar transparent panels, outwardly of said support structure, and inwardly of said third contiguous plurality of planar transparent panels;

wherein said third work station is so located relative to said third contiguous plurality of planar transparent panels and said support structure that said third contiguous plurality of planar transparent panels constitutes a means for providing a controller at said third work station with a lateral field of view of at least 180 degrees through said third contiguous plurality of planar transparent panels, which field of view is uninterrupted by mullions or other structural supporting elements.

6. A tower structure as recited in claim 1, wherein each of said first and second contiguous plurality of planar transparent panels comprises a central planar portion formed of a plurality of planar transparent panels, and first and second side planar portions flanking said central planar portion on opposite sides thereof and at oblique angles thereto.

7. A tower structure as recited in claim 6, wherein said plurality of supporting columns comprises four structural columns which define therebetween an area, and each of said first and second work stations is disposed outwardly of said area.

8. A tower structure as recited in claim 7, wherein said four structural columns are respectively disposed at opposing lateral sides of said first and second contiguous pluralities of planar transparent panels.

9. A tower structure as recited in claim 7, wherein said four structural columns lie between a first pair of parallel lines respectively extending between respective first lateral sides of said central portions of said first and second contiguous pluralities of planar transparent panels and between respective second lateral sides of said central portions of said first and second contiguous pluralities of planar transparent panels, and said four structural columns lie between a second pair of parallel lines respectively extending between respective first lateral sides of said third and fourth contiguous pluralities of planar transparent panels and between respective second lateral sides of said third and fourth contiguous pluralities of planar transparent panels.

* * * * *